US011286931B2

(12) United States Patent
Uekawa

(10) Patent No.: US 11,286,931 B2
(45) Date of Patent: Mar. 29, 2022

(54) SCROLL COMPRESSOR HAVING A SHAFT SUPPORT PORTION INCLUDING A CLOSING PORTION

(71) Applicant: Samsung Electronics Co., Ltd., Suwon-si (KR)

(72) Inventor: Takashi Uekawa, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/001,822

(22) Filed: Aug. 25, 2020

(65) Prior Publication Data

US 2021/0062809 A1 Mar. 4, 2021

(30) Foreign Application Priority Data

Aug. 27, 2019 (JP) ..... JP2019-155037
Jun. 22, 2020 (KR) ..... 10-2020-0075470

(51) Int. Cl.
*F04C 18/02* (2006.01)
*F04C 29/02* (2006.01)
(Continued)

(52) U.S. Cl.
CPC ..... *F04C 18/0215* (2013.01); *F04C 18/0253* (2013.01); *F04C 29/0021* (2013.01);
(Continued)

(58) Field of Classification Search
CPC .. F04C 2/025; F04C 18/0215; F04C 18/0253; F04C 18/0261; F04C 15/0042;
(Continued)

(56) References Cited

U.S. PATENT DOCUMENTS 4,774,816 A 10/1988 Uchikawa et al.
6,030,192 A * 2/2000 Hill ..... F04C 18/0215 418/55.2
(Continued)

FOREIGN PATENT DOCUMENTS

JP H07-091384 A 4/1995
JP 2002161875 A * 6/2002
(Continued)

OTHER PUBLICATIONS

International Search Report of the International Searching Authority in connection with International Application No. PCT/KR2020/011276 dated Dec. 23, 2020, 3 pages.

*Primary Examiner* — Laert Dounis

(57) ABSTRACT

Provided is a scroll compressor including a sealed case, a fixed scroll portion fixed at an inside of the sealed case and provided with a fixed scroll vane, an orbiting scroll portion provided with an orbiting scroll vane that is coupled to the fixed scroll vane, and a rotating shaft formed to allow the orbiting scroll portion to orbit. The orbiting scroll portion is provided at a center thereof with a shaft support portion such that the orbiting scrolling portion is coupled to the rotating shaft. The shaft support portion includes a closing portion provided to cover an end portion of the rotating shaft, and slide while in contact with an inner surface of the fixed scroll portion, and a high-pressure space formed in an outer surface of the closing portion that faces the inner surface of the fixed scroll portion, and on which a discharge pressure acts.

17 Claims, 20 Drawing Sheets

(51) Int. Cl.
*F04C 29/00* (2006.01)
*F04C 23/00* (2006.01)

(52) U.S. Cl.
CPC ..... *F04C 29/023* (2013.01); *F04C 23/008* (2013.01); *F04C 2210/14* (2013.01); *F04C 2240/30* (2013.01); *F04C 2240/56* (2013.01); *F04C 2240/60* (2013.01); *F04C 2240/603* (2013.01)

(58) Field of Classification Search
CPC ..... F04C 15/0065; F04C 29/0021; F04C 29/0057; F04C 2240/60; F04C 2240/603; F04C 2240/605; F01C 1/0215; F01C 1/0253; F01C 1/0261
See application file for complete search history.

(56) References Cited

U.S. PATENT DOCUMENTS

| | | | | |
|---|---|---|---|---|
| 7,905,715 | B2 | 3/2011 | Hiwata et al. | |
| 2013/0071278 | A1* | 3/2013 | Lee | F04C 29/023 418/55.2 |
| 2014/0348681 | A1* | 11/2014 | Obrist | F04C 18/0253 418/55.5 |
| 2014/0348682 | A1* | 11/2014 | Obrist | F04C 27/005 418/55.5 |
| 2018/0258933 | A1* | 9/2018 | Obrist | F04C 18/0215 |
| 2018/0335032 | A1* | 11/2018 | Obrist | F04C 27/005 |

FOREIGN PATENT DOCUMENTS

| | | | |
|---|---|---|---|
| JP | 2008-014288 | A | 1/2008 |
| WO | 2014189240 | A1 | 11/2014 |

* cited by examiner

SCROLL COMPRESSOR HAVING A SHAFT SUPPORT PORTION INCLUDING A CLOSING PORTION

CROSS-REFERENCE TO RELATED APPLICATION

This application is based on and claims priority under 35 U.S.C. § 119 to Japanese Patent Application No. 2019-155037, filed on Aug. 27, 2019 in the Japan Patent Office, and Korean Patent Application No. 2020-0075470, filed on Jun. 22, 2020 in the Korean Intellectual Property Office, the disclosures of which are incorporated herein by reference.

BACKGROUND

1. Field

The disclosure relates to a scroll compressor.

2. Description of the Related Art

A scroll compressor has a fixed scroll vane of a fixed scroll portion interleaved with an orbiting scroll vane of an orbiting scroll portion, and when the orbiting scroll vane orbits, a compression chamber formed between the fixed scroll vane and the orbiting scroll vane continuously moves, causing gas to be sucked in and compressed.

International application patent publication WO2014-189240 proposes a scroll compressor installed such that an eccentric portion of a rotating shaft enters a central portion of an orbiting scroll vane of an orbiting scroll portion.

Such an orbiting scroll portion of the scroll compressor includes a cylindrical shaft support portion provided in the central portion to have the eccentric portion of the rotating shaft enter and be coupled, and a spiral orbiting scroll vane disposed outside the shaft support portion. The eccentric portion of the rotating shaft coupled to the shaft support portion remains radially overlapping the orbiting scroll vane. The shaft support portion slides in a state in which an outer surface of a closing portion covering an end portion of the rotating shaft is in contact with the inner surface of the fixed scroll portion.

However, in such a scroll compressor, an orbiting of the orbiting scroll vane moves the compression chamber, achieving compression of gas, and the position and pressure of the compression chamber frequently changes, and thus the size, working position, and working area of a load acting on the outer surface of the shaft support portion in contact with an inner surface of the fixed scroll portion also frequently change. Therefore, it is difficult to stabilize the operation of the orbiting scroll portion. In addition, since the area of an upper surface of the shaft support portion that makes friction with the inner surface of the fixed scroll portion is large, energy loss due to the friction is also great.

RELATED ART DOCUMENT

Patent Document

International application patent publication WO2014-189240 (Dec. 27, 2014)

SUMMARY

Therefore, it is an object of the disclosure to provide a scroll compressor capable of stabilizing a load acting on an upper surface of a shaft support portion of an orbiting scroll portion.

It is an object of the disclosure to provide a scroll compressor capable of reducing energy loss due to friction between a shaft support portion of an orbiting scroll portion and a fixed scroll portion.

Additional aspects of the disclosure will be set forth in part in the description which follows and, in part, will be obvious from the description, or may be learned by practice of the disclosure.

Therefore, it is an aspect of the disclosure to provide a scroll compressor including: a sealed case; a fixed scroll portion fixed at an inside of the sealed case and provided with a fixed scroll vane; an orbiting scroll portion provided with an orbiting scroll vane that is coupled to the fixed scroll vane; and a rotating shaft formed to allow the orbiting scroll portion to orbit, wherein the orbiting scroll portion is provided at a center portion thereof with a shaft support portion formed to allow the orbiting scrolling portion to be coupled to the rotating shaft, and the shaft support portion includes: a closing portion provided to cover an end portion of the rotating shaft, and slide while in contact with an inner surface of the fixed scroll portion; and a high-pressure space formed in an outer surface of the closing portion that faces the inner surface of the fixed scroll portion, and on which a discharge pressure acts.

The closing portion may be provided to face the inner surface of the fixed scroll portion in a direction the orbiting scroll portion is coupled to the fixed scroll portion.

The sealed case may include a discharge space to which a refrigerant discharged from a compression portion formed by the fixed scroll portion and the orbiting scroll portion flows, and the fixed scroll portion may include a communication path that communicates the discharge space with the high-pressure space.

The high-pressure space may be provided to allow at least a portion of the refrigerant discharged from the discharge space to be introduced through the communication path when the orbiting scroll portion orbits.

The communication path may be provided to be open in a direction corresponding to a direction in which the orbiting scroll portion is coupled to the fixed scroll portion.

The shaft support portion may include a sealing portion that forms a circumference of the high-pressure space and slides while in contact with the inner surface of the fixed scroll portion.

The sealing portion may have a thickness equal to a thickness of the orbiting scroll vane.

The high-pressure space may be formed to be recessed from the outer surface of the closing portion at a depth of 0.5 mm or greater.

The shaft support portion may include: an inner space formed between the end portion of the rotating shaft and the closing portion and disposed at a side opposite to the high-pressure space; and a communication hole formed to allow the high-pressure space to communicate with the inner space.

The rotating shaft may include an oil supply passage formed inside the rotating shaft and through which a lubricant is caused to flow, and at least a portion of the oil supply passage is provided to communicate with the inner space.

The inner space and the high-pressure space may be provided to be filled with the lubricant supplied through the oil supply passage.

The fixed scroll portion may include a friction surface that makes friction with a circumferential portion of the orbiting scroll portion and an auxiliary oil supply passage provided to allow the lubricant of the high-pressure space to flow to the friction surface.

It is another aspect of the disclosure to provide a scroll compressor including: a sealed case including a discharge space to which a high pressure refrigerant flows; a fixed scroll portion fixed at an inside of the sealed case and provided with a fixed scroll vane; an orbiting scroll portion provided with an orbiting scroll vane that is coupled to the fixed scroll vane; a compression portion formed by the fixed scroll portion and the orbiting scroll portion, and configured to discharge the refrigerant to the discharge space; and a rotating shaft formed to allow the orbiting scroll portion to orbit, wherein the orbiting scroll portion is provided at a center portion thereof with a shaft support portion formed to allow the orbiting scrolling portion to be coupled to the rotating shaft, and the shaft support portion includes a closing portion provided to cover an end portion of the rotating shaft and slide while in contact with an inner surface of the fixed scroll portion; and one of the closing portion and the inner surface of the fixed scroll portion includes a high-pressure space that communicates with the discharge space and on which a discharge pressure acts.

The high-pressure space may be formed on an inner surface of the fixed scroll portion facing the closing portion of the shaft support portion.

The fixed scroll portion may include a communication path that communicates the discharge space with the high-pressure space.

The shaft support portion may include: an inner space formed by separation between the end portion of the rotating shaft and the inner surface of the closing portion; and a communication hole formed to allow the high-pressure space to communicate with the inner space.

The inner space and the high-pressure space may be filled with a lubricant supplied through an oil supply passage of the rotating shaft.

The fixed scroll portion may include an auxiliary oil supply passage provided to allow the lubricant of the high-pressure space to flow to a friction surface that makes friction with a circumferential portion of the orbiting scroll portion.

It is another aspect of the disclosure to provide a scroll compressor including: a fixed scroll portion fixed at an inside of a sealed case and provided with a fixed scroll vane; an orbiting scroll portion provided with an orbiting scroll vane that is coupled to the fixed scroll vane; a rotating shaft formed to allow the orbiting scroll portion to orbit; and a shaft support portion provided at a center portion of the orbiting scroll portion and to which the rotating shaft is coupled, the shaft support portion including a closing portion that covers an end portion of the rotating shaft and is slidably supported while in contact with an inner surface of the fixed scroll portion, wherein the fixed scroll portion includes an opening allowing an outer surface of the closing portion of the shaft support portion facing the inner surface of the fixed scroll portion to be exposed to a discharge pressure of outside of the fixed scroll portion.

The opening may remain closed by the outer surface of the closing portion during an orbiting movement of the orbiting scroll portion.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

FIGS. 1 through 18, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, a scroll compressor according to embodiments of the disclosure will be described with reference to the drawings.

The scroll compressor may have an orbiting scroll portion pressed toward a fixed scroll portion in the axial direction, to cause a compression chamber formed between the fixed scroll portion and the orbiting scroll portion to be sealed. In order to stabilize the operation of the orbiting scroll portion, the scroll compressor minimizes a thrust load acting on the orbiting scroll portion.

The scroll compressor employing the disclosure includes a shaft support portion to which a rotating shaft is coupled at a height at which the orbiting scroll vane of the orbiting scroll portion is located. An eccentric portion of the rotating shaft passes through a lower side of the orbiting scroll portion and enters the shaft support portion.

Such a scroll compressor may reduce occurrence of a moment of the orbiting scroll portion due to a load acting on the orbiting scroll portion from the rotating shaft and compression of gas, so that a thrust load acting on the orbiting scroll portion is reduced, and the operation of the orbiting scroll portion is stabilized. In addition, one-sided contact of the shaft support portion is reduced so that the performance is improved and reliability of the device is increased.

Embodiments described below relate to a scroll compressor in which a closing portion of a shaft support portion that covers an end portion of a rotating shaft slides while in contact with an inner surface of a fixed scroll portion, and relate to stabilizing the operation of an orbiting scroll portion by stabilizing a load acting on the closing portion of the shaft support portion.

Figure 1:
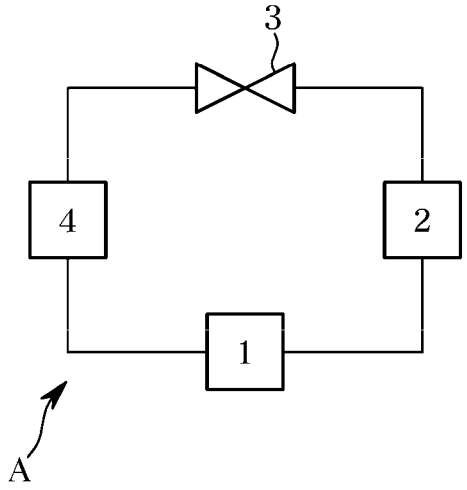
FIG. 1 is a view illustrating a refrigerant flow of an air conditioner according to an embodiment of the disclosure.

The scroll compressor may be formed as a configuration of such devices as an air conditioner or refrigerator to which a refrigeration cycle may be applied. That is, as shown in FIG. 1, the scroll compressor 1 may be provided as a configuration of an air conditioner A. However, the disclosure is not limited thereto, and the scroll compressor 1 may be provided as a configuration of another device, such as a refrigerator. The air conditioner A may include the scroll compressor 1, an outdoor heat exchanger 2 having a compressed high temperature and high pressure refrigerant heat-exchanged with outside air, an expansion device 3 decompressing the refrigerant discharged from the outdoor heat exchanger 2 into a low temperature refrigerant, and an indoor heat exchanger 4 lowering the temperature of air by having the low temperature refrigerant heat-exchanged with indoor air. Hereinafter, the scroll compressor 1 will be described in detail.

Figure 2:
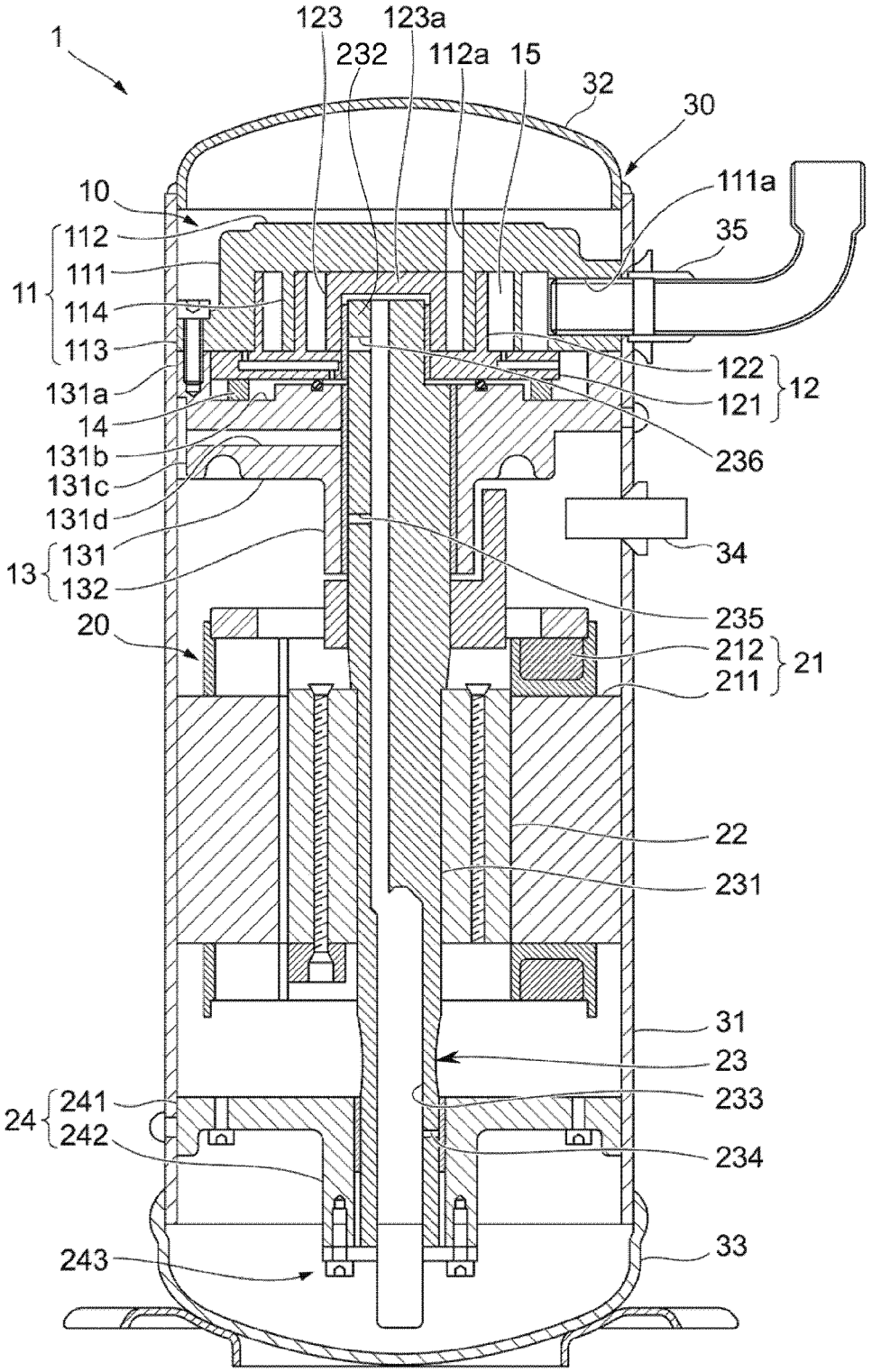
FIG. 2 is a longitudinal sectional view illustrating a scroll compressor to which the disclosure is applied.

FIG. 2 is a longitudinal sectional view illustrating a scroll compressor to which the disclosure is applied.

Referring to FIG. 2, the scroll compressor 1 may be applied to a refrigerant circuit of an air conditioner, a refrigerator, a heat pump, and the like to compress a refrigerant. The scroll compressor 1 includes a compression portion 10 for compressing a refrigerant, a driving motor 20 for driving the compression portion 10, and a rotating shaft 23 for transmitting a rotational force of the driving motor 20 to the compression portion 10, and a sealed case 30 for accommodating the compression portion 10 and the driving motor 20.

The scroll compressor 1 is also referred to as a vertical scroll compressor because the rotating shaft 23 is disposed with the axis line directed toward the gravity direction, and is also referred to as a sealed scroll compressor due to including the sealed case 30. Hereinafter, the axis line direction of the rotating shaft 23 may be referred to as "upper side and lower side direction", and the upper side of FIG. 2 may be described as "upper side" and the lower side of FIG. 2 may be described as "lower side". Here, a vertical scroll compressor is presented as an example, but the disclosure may also be applied to a horizontal scroll compressor.

The compression portion 10 includes a fixed scroll portion 11 fixed at an inside of the sealed case 30, an orbiting scroll portion 12 orbiting in a state of being coupled to the fixed scroll portion 11, a frame 13 supporting the fixed scroll portion 11 in a state of being fixed at an inside of the sealed case 30, and an Oldham's ring 14 allowing an orbiting movement while limiting rotation of the orbiting scroll portion 12.

The fixed scroll portion 11 includes a cylindrical portion 111, a cover portion 112 integrally formed with the cylindrical portion 111 while covering an upper side of the cylindrical portion 111, a protrusion portion 113 protruding radially outside from a lower end of the cylindrical portion 111, and a fixed scroll vane 114 integrally formed with an inner surface of the cover portion 112 and bent in a spiral shape. The fixed scroll portion 11 may be formed of a cast iron material, such as FC250.

The cylindrical portion 111 has a through hole 111*a* opening in the radial direction. A refrigerant may be introduced to a space surrounded by the cylindrical portion 111, the cover portion 112, and the orbiting scroll portion 12 through the through hole 111*a*.

The cover portion 112 is provided with a through hole 112*a* opening in the vertical direction at a position slightly deviated from the center portion thereof in the radial direction. Therefore, the compressed refrigerant may be discharged from the space surrounded by the cylindrical portion 111, the cover portion 112, and the orbiting scroll portion 12 to the outside of the compression portion 10 through the through hole 112*a*.

The fixed scroll portion 11 may be fixed to the frame 13 by a bolt, a positioning pin, and the like which pass through the protrusion portion 113 to be fastened to the frame 13.

The orbiting scroll portion 12 includes a disk-shaped orbiting plate 121, an orbiting scroll vane 122 formed to protrude upward from an upper surface of the orbiting plate 121 and bent in a spiral shape, a shaft support portion 123 formed to protrude from the center of the upper surface of the orbiting plate 121 in a cylindrical shape. The orbiting scroll portion 12 may be formed of an FC material or an FCD material.

The orbiting scroll vane 122 is engaged and coupled to the fixed scroll vane 114 of the fixed scroll portion 11. The orbiting scroll vane 122 and the fixed scroll vane 114 form a compression chamber 15 divided within a space surrounded by the cylindrical portion 111, the cover portion 112, and the orbiting plate 121.

The compression portion 10 may have the orbiting scroll vane 122 orbit relative to the fixed scroll vane 114 such that the volume of the compression chamber 15 is changed to compress a refrigerant. When the orbiting scroll vane 122 orbits, the compression chamber 15 between the fixed scroll vane 114 and the orbiting scroll vane 122 gradually moves toward the center and decreases to compress the refrigerant.

The shaft support portion 123 of cylindrical shape rotatably supports an eccentric portion 232 of the rotating shaft 23. The eccentric portion 232 of the rotating shaft 23 is installed to pass through the central portion of the orbiting plate 121 of the orbiting scroll vane 122 and enter the inside of the shaft support portion 123. Therefore, the eccentric portion 232 of the rotating shaft 23 and the orbiting scroll vane 122 are positioned to overlap each other in the radial direction. The shaft support portion 123 includes a closing portion 123*a* covering an end portion (an upper end surface) of the eccentric portion 232 of the rotating shaft 23. An outer surface of the closing portion 123*a* is slidably supported on an inner surface of the cover portion 112 of the fixed scroll portion 11.

The frame 13 includes a first cylindrical portion 131 and a second cylindrical portion 132 extending downward from the lower end of the first cylindrical portion 131. In the frame 13, the outer surface of the first cylindrical portion 131 is fixed to the inner surface of an intermediate case 31 of the sealed case 30. The rotating shaft 23 passes through the centers of the first cylindrical portion 131 and the second cylindrical portion 132 in the vertical direction and are rotatably supported by bearings installed on the inner surfaces of the first cylindrical portion 131 and the second cylindrical portion 132.

The first cylindrical portion 131 is provided with a protrusion portion 131*a* that is coupled to the protrusion portion 113 of the fixed scroll portion 11. The protrusion portion 131*a* protrudes upward from an upper surface of a periphery of the first cylindrical portion 131. The fixed scroll portion 11 is fixed to the frame 13 without shaking with the protrusion portion 113 fixed to the protrusion portion 131*a* of the first cylindrical portion 131 by bolting.

The first cylindrical portion 131 includes a groove portion 131*b* formed to be recessed downward from the upper surface thereof for installation of the Oldham ring 14. The groove portion 131*b* may be located between the rotating shaft 23 and the protrusion portion 131*a*. The Oldham ring 14 has an upper side coupled to the orbiting plate 121 of the orbiting scroll portion 12 while being accommodated in the groove portion 131*b*. Therefore, the Oldham ring 14 may allow the orbiting movement of the orbiting scroll portion 12 while limiting the rotation of the orbiting scroll portion 12.

The first cylindrical portion 131 includes a groove 131*c* formed on the outer circumferential surface to extend in the vertical direction and a communication hole 131*d* allowing an inner surface of the first cylindrical portion 131, on which the rotating shaft 23 is located, with the groove 131*c* in the radial direction.

The compression portion 10 includes a discharge passage through which the refrigerant compressed by the fixed scroll portion 11 and the orbiting scroll portion 12 flows. The discharge passage has one side connected to the through hole 112*a* of the cover portion 112 through which the refrigerant is discharged, and the other side communicating with a space below the frame 13 inside the sealed case 30.

The driving motor 20 is installed inside the sealed case 30 below the compression portion 10. The driving motor 20 includes a stator 21 having the outer surface fixed to the inner surface of the intermediate case 31 of the sealed case 30, a rotor 22 installed in the center of the stator 21 to be rotatable in a state of being coupled to the rotating shaft 23, and a support member 24 rotatably supporting the rotating shaft 23.

The stator 21 includes a main body 211 and a coil 212 wound around the main body 211. The main body 211 has a substantially cylindrical shape, and may be provided by stacking a plurality of electrical steel sheets. The main body 211 may have an outer diameter slightly larger than an inner diameter of the intermediate case 31 of the sealed case 30, and may be mounted on the inner surface of the intermediate case 31 in an interference fit manner. The main body 211 may be coupled to the intermediate case 31 by a shrink fit method or a press fit method.

The main body 211 of the stator 21 is provided with a plurality of teeth on an inner side facing the outer surface of the rotor 22 along the circumferential direction. The coil 212 is inserted into a slot between teeth adjacent to each other, of the plurality of teeth. The main body 211 may be provided in a concentrated winding type in which the coil 212 is inserted into a slot between a plurality of teeth.

The rotor 22 has a cylindrical shape as a whole, and may be provided by stacking a plurality of electrical steel sheets in a ring shape. The rotor 22 is formed to have an inner diameter smaller than an outer diameter of the rotating shaft 23 and may be coupled to the outer surface of the rotating shaft 23 in an interference fit manner. The rotor 22 and the rotating shaft 23 may be coupled to each other by a method of pressing fitting the rotating shaft 23 into the rotor 22. The rotor 22 rotates together with the rotating shaft 23 while being fixed to the rotating shaft 23. The rotor 22 may include a permanent magnet installed therein.

The outer diameter of the rotor 22 is formed smaller than the inner diameter of the main body 211 of the stator 21. Therefore, the outer surface of the rotor 22 is spaced apart from the inner surface of the stator 21.

The rotary shaft 23 includes a main shaft portion 231 to which the rotor 22 is coupled, and the eccentric portion 232 provided on the main shaft portion 231 and having a center deviated from a center of the main shaft portion 231. The main shaft portion 231 has a lower portion rotatably supported by the support member 24, and an upper portion rotatably supported by the frame 13 of the compression portion 10. The eccentric portion 232 is rotatably coupled to the shaft support portion 123 of the orbiting scroll portion 12.

The rotating shaft 23 includes an oil supply passage 233 that is open in the axial direction, a first oil supply hole 234 that communicates the oil supply passage 233 with a bearing position of the support member 24, a second oil supply hole 235 that communicates the oil supply passage 233 with a bearing position of the frame 13, and a third oil supply hole 236 that communicates the oil supply passage 233 with a bearing of the inner surface of the shaft support portion 123. The first oil supply hole 234, the second oil supply hole 235, and the third oil supply hole 236 are radially open from the oil supply passage 233 to the outer surface of the rotating shaft 23.

The support member 24 includes a first cylindrical portion 241 and a second cylindrical portion 242 extending downward from a lower end of the first cylindrical portion 241. The support member 24 has the outer surface of the first cylindrical portion 241 fixed to the inner surface of the intermediate case 31 of the sealed case 30. The rotating shaft 23 passes through the centers of the first cylindrical portion 241 and the second cylindrical portion 242 in the vertical direction and are rotatably supported by bearings installed on the inner surfaces of the first cylindrical portion 241 and the second cylindrical portion 242.

The first cylindrical portion 241 of the support member 24 includes a hole or a groove communicating an upper side space and a lower side space of the first cylindrical portion 241 with each other. A pump 243 for pumping a lubricant is installed at the bottom of the second cylindrical portion 242 of the support member 24.

The sealed case 30 includes the intermediate case 31 disposed in a middle portion thereof in the vertical direction, an upper case 32 covering an upper opening of the intermediate case 31, and a lower case 33 covering a lower opening of the intermediate case 31. The intermediate case 31 supports the frame 13 of the compression portion 10, the stator 21 of the driving motor 20, and the support member 24 accommodated therein. The lower case 33 is provided in a bowl shape to collect a lubricant therein.

The sealed case 30 includes a discharge pipe 34 for discharging a high-pressure refrigerant compressed in the compression portion 10 to the outside of the sealed case 30, and a suction pipe 35 for guiding a refrigerant sucked into the compression portion 10 from the outside of the sealed case 30. The suction pipe 25 is provided at a position corresponding to the through hole 111*a* formed in the cylindrical portion 111 of the fixed scroll portion 11.

Hereinafter, the operation of the scroll compressor 1 will be described.

In the scroll compressor 1, the rotating shaft 23 is rotated by the operation of the driving motor 20, and the orbiting scroll portion 12 coupled to the eccentric portion 232 of the rotating shaft 23 orbits relative to the fixed scroll portion 11. When the orbiting scroll portion 12 is rotated relative to the fixed scroll portion 11, a low-pressure refrigerant is sucked from the outside of the sealed case 30 into the compression chamber 15 of the compression portion 10 through the suction pipe 35, and is compressed by the volume change of the compression chamber 15.

The high-pressure refrigerant compressed in the compression chamber 15 flows downward of the compression portion 10 through the through-hole 112*a* of the cover portion 112 and the discharge passage. The high-pressure refrigerant discharged to the lower side of the compression portion 10 is discharged to the outside of the sealed case 30 through the discharge pipe 34. The high-pressure refrigerant may flow into a gap between the rotor 22 and the stator 21 or a gap between the stator 21 and the intermediate case 31 in the process of being discharged to the outside of the sealed case 30. The high-pressure refrigerant discharged to the outside of the sealed case 30 may be condensed, expanded, and evaporated in the refrigerant circuit, and then sucked back to the compression portion 10 through the suction pipe 35.

A lubricant collected in the lower case 33 of the sealed case 30 rises along the oil supply passage 233 of the rotating shaft 23 by the operation of the pump 243, and is supplied to each bearing of the rotating shaft 23 through the first oil supply hole 234, the second oil supply hole 235, and the third oil supply hole 236 formed in the rotating shaft 23, or is supplied to a sliding part of the compression portion 10.

The lubricant oil supplied to the sliding part of the compression portion 10, or the lubricant oil supplied to the bearing of the rotating shaft 23 through the second oil supply hole 235 and the third oil supply hole 236 is collected in an inner lower portion of the sealed case 30 through the communication hole 131*d* and the groove 131*c* formed in the frame 13, the gap between the rotor 22 and the stator 21, the hole formed in the support member 24, etc. In this process, the lubricant flows through a gap between the rotor 22 and the stator 21 together with the high-pressure refrigerant and cools the driving motor 20 and flows downward. Thereafter, the lubricant flowing together with the high-pressure refrigerant is separated from the refrigerant and is collected in the inner lower portion of the sealed case 30.

Figure 3:
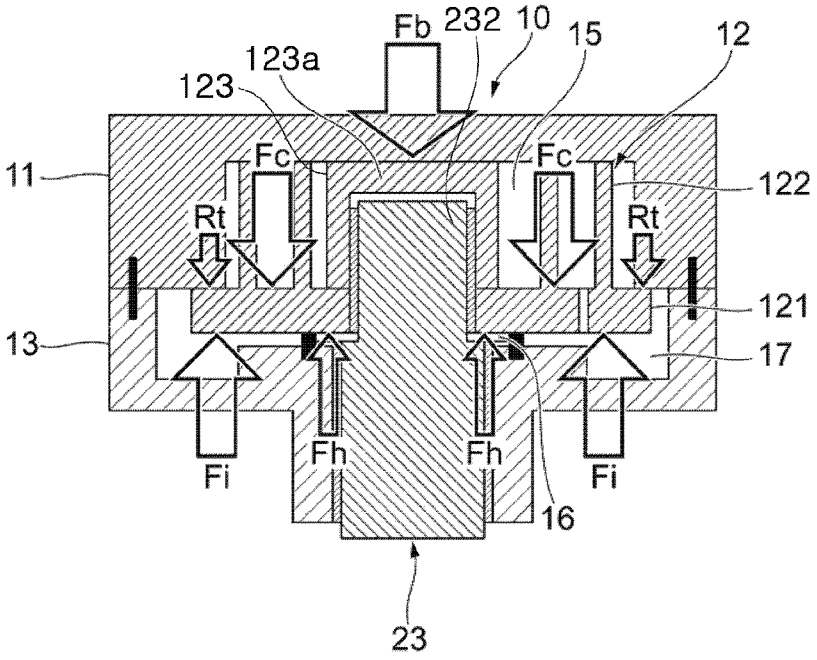
FIG. 3 is a cross-sectional view schematically illustrating a compression portion of the scroll compressor of FIG. 1.

As illustrated in FIG. 3, in the process of operating the scroll compressor 1, an axial load acts on the compression portion 10. FIG. 2 schematically illustrates the configuration of the compression portion 10 to describe the axial load, in which the oil supply passage or the communication hole provided in the rotating shaft 23 are omitted.

Referring to FIG. 3, the axial load acting on the compression portion 10 may include a load Fc, load Fh, and load Fi. The load Fc is a pressure acting on the orbiting scroll portion 12 from the compression chamber 15 during compression of the refrigerant. The load Fh is a pressure of a high-pressure chamber 16 provided on the opposite side of the orbiting scroll vane 122 of the orbiting scroll portion 12. The load Fi is a pressure of an intermediate pressure chamber 17 provided on the opposite side of the orbiting scroll vane 122 of the orbiting scroll member 12.

In addition to the axial loads, a load Fb acts on the outer surface of the closing portion 123*a* of the shaft support portion 123. The load Fb acts in the same direction as that of the load Fc. Therefore, a thrust load Rt may act on the compression portion 10 as a result of the axial loads being offset.

Figure 4:
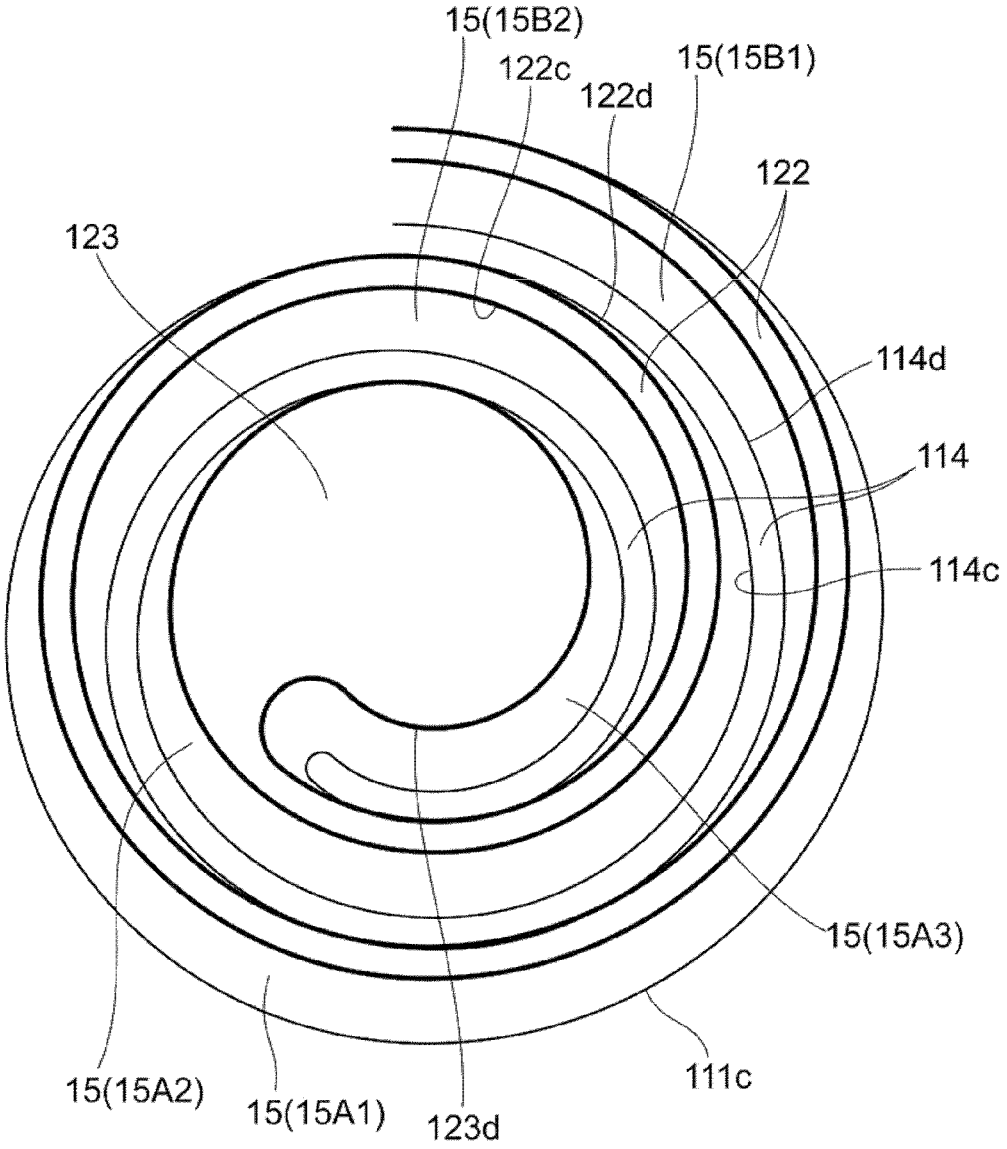
FIG. 4 is a cross-sectional view illustrating a compression chamber of the scroll compressor of FIG. 1.

Referring to FIG. 4, the compression chamber 15 is formed by the cylindrical portion 111 and the cover portion 112 of the fixed scroll portion 11, the fixed scroll vane 114, the shaft support portion 123 and the orbiting plate 121 of the orbiting scroll portion 12, and the orbiting scroll vane 122. In FIG. 4, the orbiting scroll portion 12 is indicated with a thicker line to distinguish the fixed scroll portion 11 and the orbiting scroll portion 12 from each other.

The upper surface of the closing portion 123*a* of the shaft support portion 123 is affected by the compression chamber 15 adjacent thereto. Here, a portion of the compression chamber 15 formed by an inner surface 111*c* of the cylindrical portion 111, an inner surface 114*c* of the fixed scroll vane 114, an outer surface 122*d* of the orbiting scroll vane 122, and an outer surface 123*d* of the shaft support portion 123 may be referred to as an A path including an A path-first chamber path 15A1, an A path-second chamber 15A2, and an A path-third chamber 15A3 sequentially arranged from the radial outer side to the radial inner side. In addition, a portion of the compression chamber 15 formed by an outer surface 114*d* of the fixed scroll vane 114 and an inner surface 122*c* of the orbiting scroll vane 122 is referred to as a B path including a B path-first chamber 15B1 and a B path-second chamber 15B2 from the radial outer side to the radial inner side.

Figure 6:
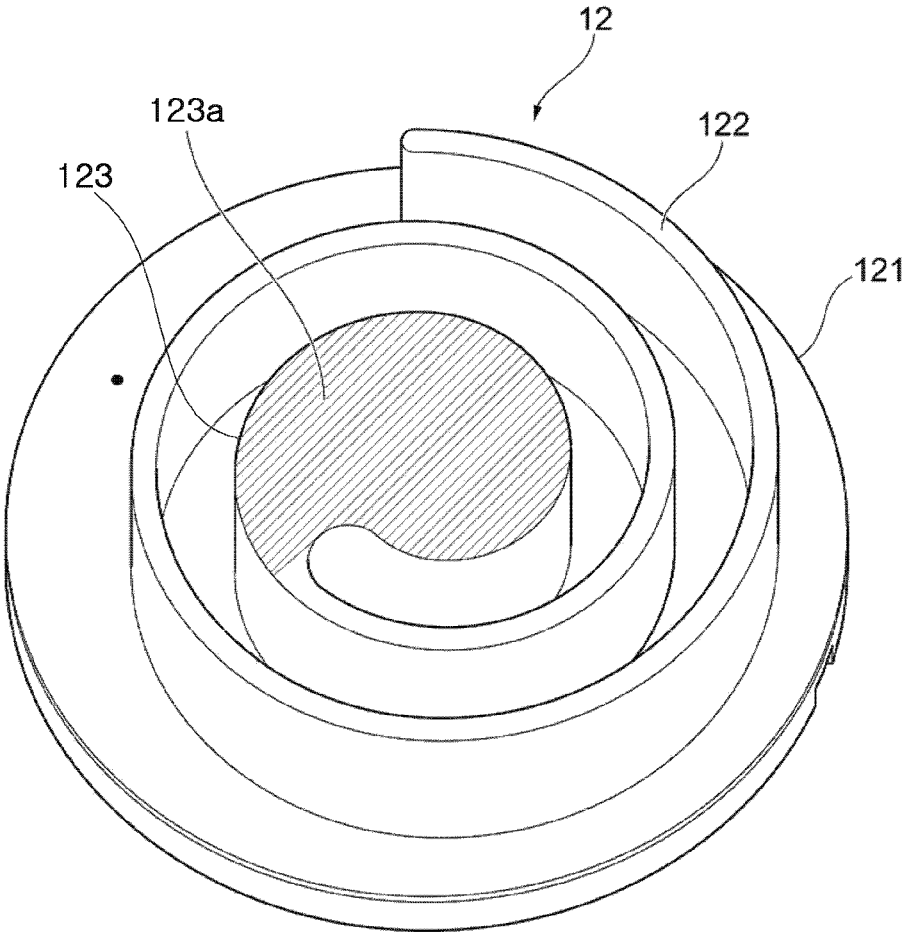
FIG. 6 is a perspective view illustrating an orbiting scroll portion of the scroll compressor of FIG. 1.

When the orbiting scroll vane 122 orbits in the state shown in FIG. 4, the upper surface of the closing portion 123*a* of the shaft support portion 123 is affected by the pressure acting on the A path-second chamber 15A2 and the A path-third chamber 15A3. Adjacent compression spaces are moved by the orbiting movement of the orbiting scroll portion 12 and the volume and pressure thereof change, and due to the pressure difference, gas movement also occurs therebetween. The gap between the upper surface of the closing portion 123*a* of the shaft support portion 123 and the inner surface of the cover portion 112 of the fixed scroll portion 11 also frequently changes. Therefore, the load Fb acting on the upper surface of the closing portion 123*a* of the shaft support portion 123 changes into a state that is not easily predicted frequently. As a result, as shown in FIG. 6, the load acting on the upper surface (the hatched area) of the shaft support portion becomes unstable.

Figure 5:
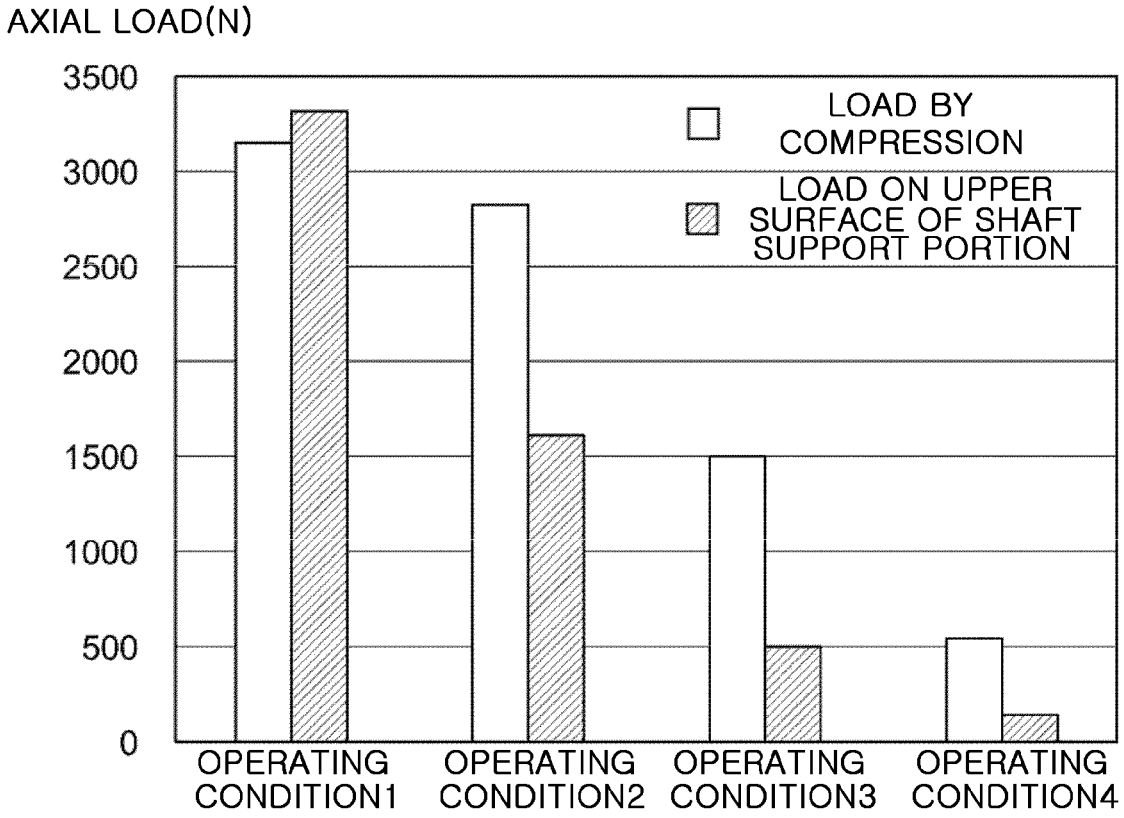
FIG. 5 illustrates a graph showing a result of comparing a compression load and a load acting on an upper surface of a shaft support portion, which varies according to operating condition of the scroll compressor of FIG. 1.

FIG. 5 illustrates a graph showing a result of comparing the load Fc of compression and the load Fb acting on the upper surface of the shaft support portion 123, which varies according to operating conditions. As shown in FIG. 5, under various operating conditions, the load Fb acting on the upper surface of the shaft support portion 123 is likely to exert an influence in a direction that the orbiting scroll portion 12 is separated from the fixed scroll portion 11.

Figure 7:
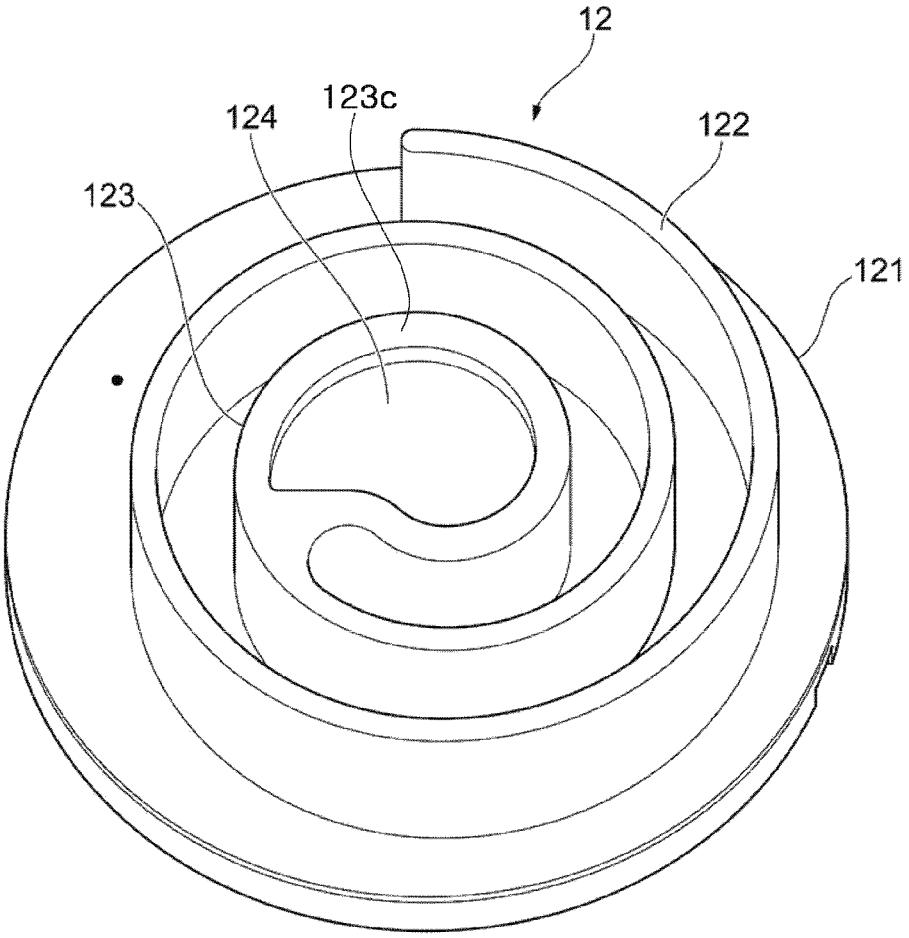
FIG. 7 is a perspective view illustrating an orbiting scroll portion of a scroll compressor according to the first embodiment of the disclosure.
Figure 8:
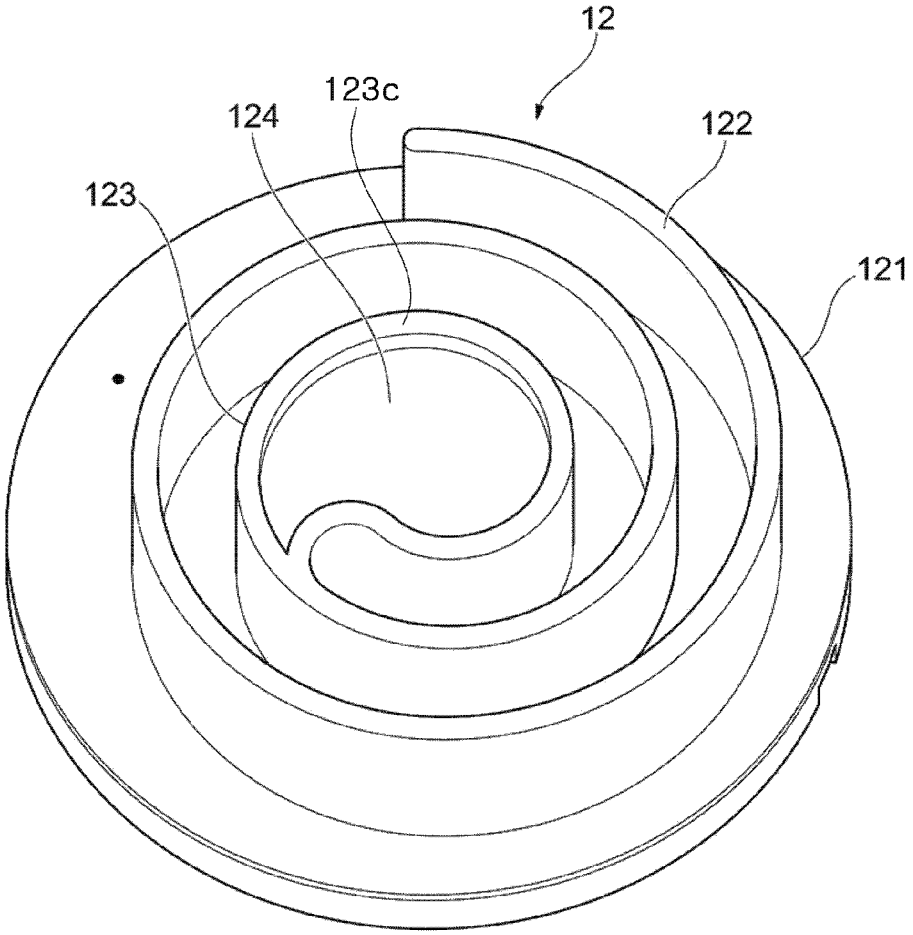
FIG. 8 is a perspective view illustrating the orbiting scroll portion of the scroll compressor according to the first embodiment of the disclosure, which shows an example in which the thickness of a sealing portion at a circumference of a high-pressure space is formed to be equal to the thickness of an orbiting scroll vane.
Figure 9:
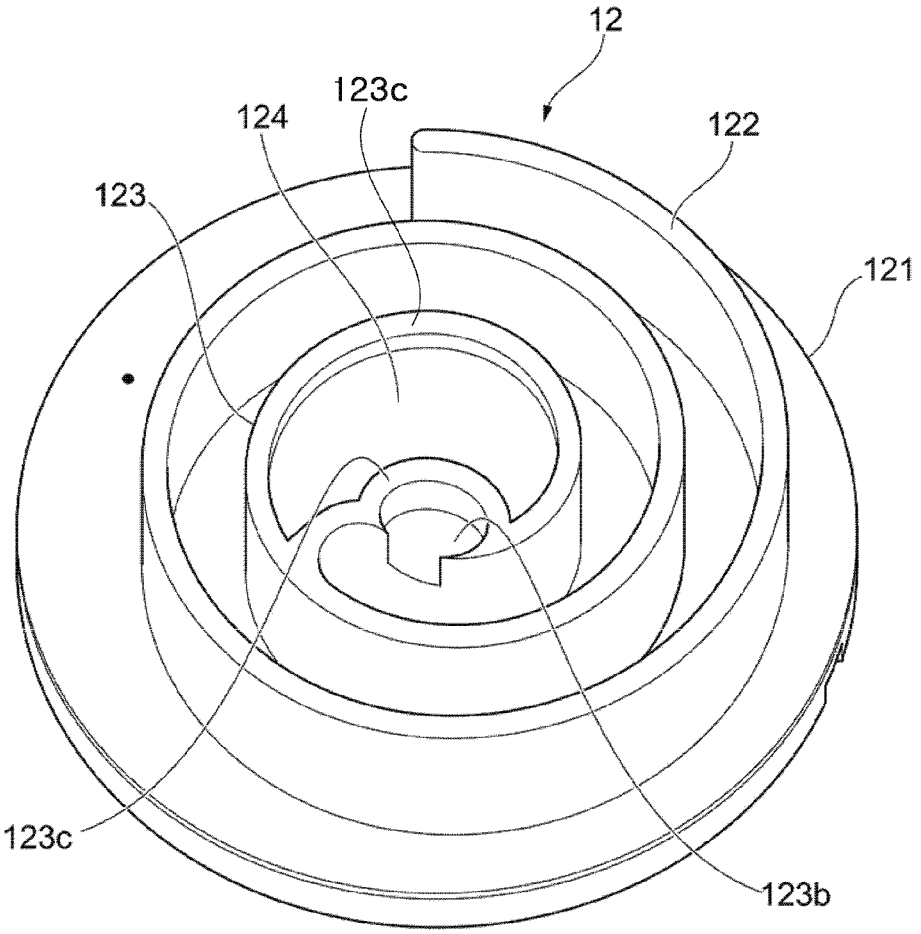
FIG. 9 is a perspective view illustrating the orbiting scroll portion of the scroll compressor according to the first embodiment of the disclosure, which shows an example in which a shaft support portion is formed with a recess divided from a high-pressure space.

FIGS. 7 to 9 are perspective views illustrating the orbiting scroll portion of the scroll compressor according to the first embodiment of the disclosure. Referring to FIG. 7, the shaft support portion 123 of the orbiting scroll portion 12 is provided with a high-pressure space 124 formed on the upper surface of the closing portion 123*a* facing the inner surface of the cover portion 112 of the fixed scroll portion 11 such that the discharge pressure of the compression portion 10 acts on the high-pressure space 124. Here, the discharge pressure is the pressure of gas discharged to the inside of the sealed case 30 through the through hole 112*a* of the compression portion 10 by compression of the compression portion 10.

When the discharge pressure acts on the high-pressure space 124 on the upper side of the shaft support portion 123, the load Fb acting on the closing portion 123*a* of the shaft support portion 123 may be stabilized. Therefore, the pressure inside the intermediate pressure chamber 17 of FIG. 3 may be set to a lower pressure, so that the efficiency and reliability of the scroll compressor 1 may be increased. The high-pressure space 124 may be formed by recessing the outer surface of the closing portion 123*a* by a depth of 0.5 mm or more.

The shaft support portion 123 may include a sealing portion 123*c* that defines a circumference of the high-pressure space 124 and slides while in contact with the inner surface of the cover portion 112 of the fixed scroll portion 11. As shown in 8, the sealing portion 123*c* may be provided with the same thickness as that of the orbiting scroll vane 122.

The shaft support portion 123 may include a recess 123*b* divided from the high-pressure space 124 on the upper surface as shown in FIG. 9. When the shaft support portion 123 includes the recess 123*b*, the high-pressure space 124 may be provided in an area except for the recess 123*b*, and the sealing portion 123*c* around the recess 123*b* may also be provided with the same thickness as that of the orbiting scroll vane 122.

Figure 10A:
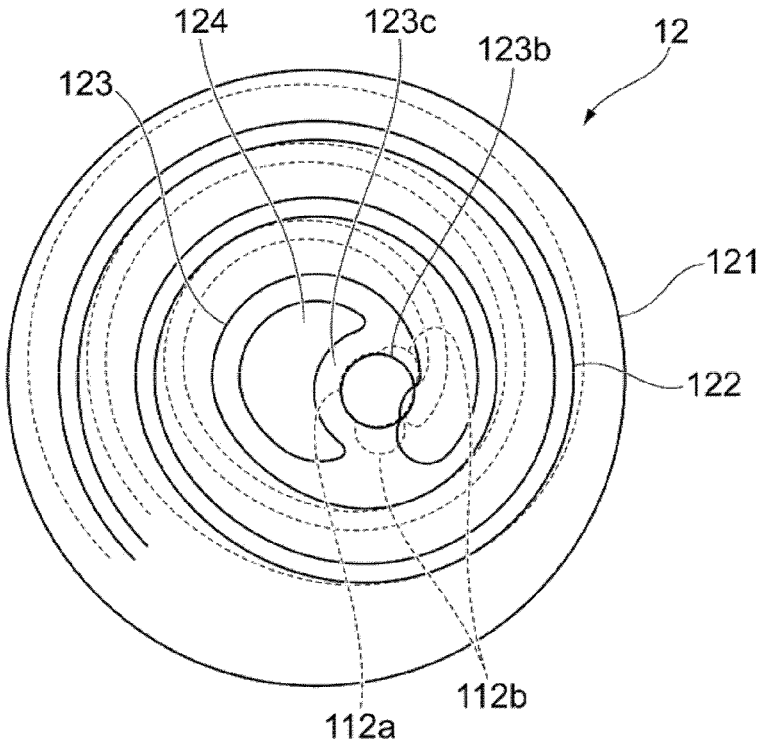
FIGS. 10A and 10B are plan views illustrating the orbiting scroll portion of the scroll compressor according to the first embodiment of the disclosure, which shows the positions of the orbiting scroll portion having the recess in the shaft support portion according to operation of the orbiting scroll portion.
Figure 10B:
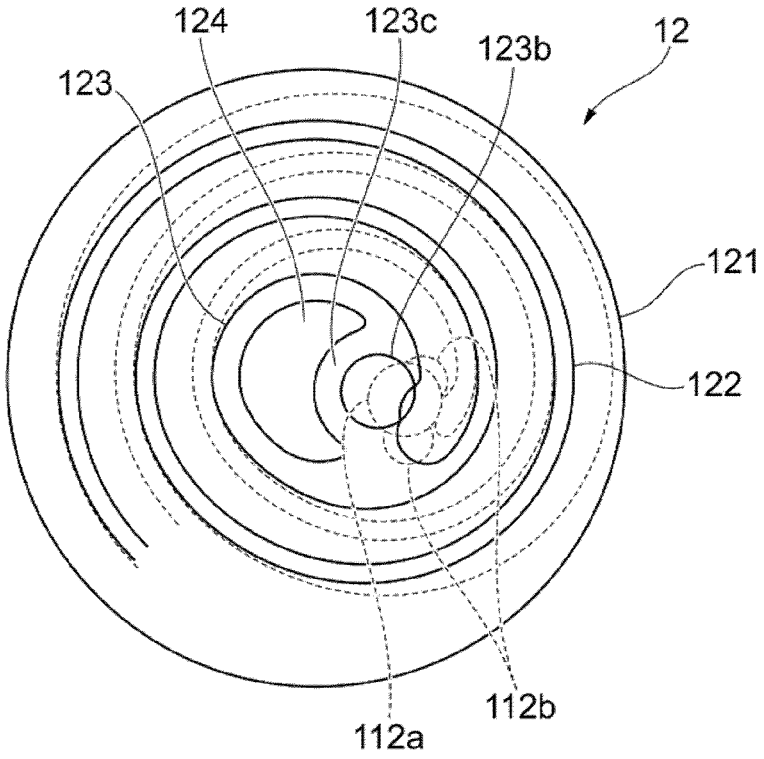
Figure 11A:
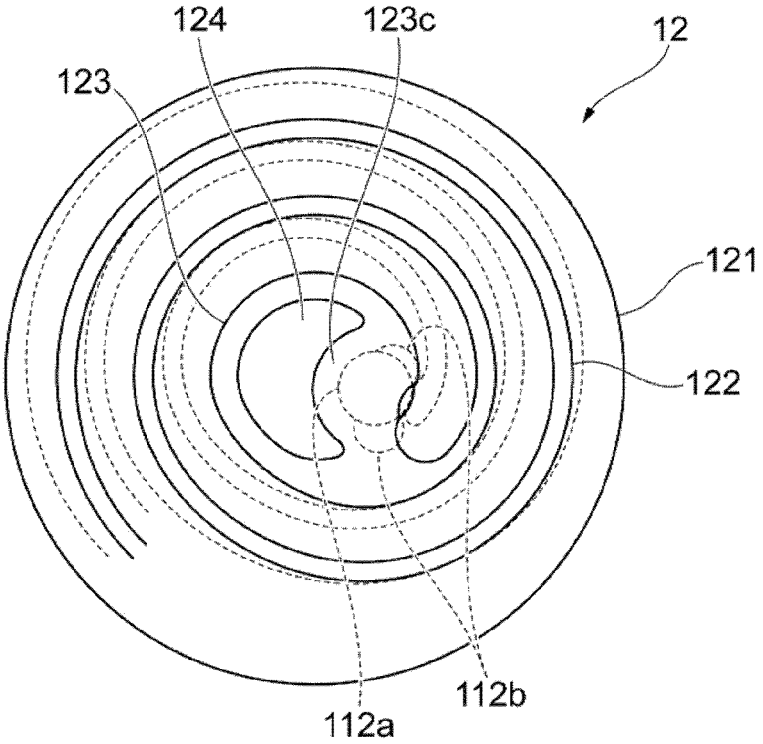
FIGS. 11A and 11B are plan views illustrating the orbiting scroll portion of the scroll compressor according to the first embodiment of the disclosure, which shows the positions of the orbiting scroll portion having no recess in the shaft support portion according to operation of the orbiting scroll portion.
Figure 11B:
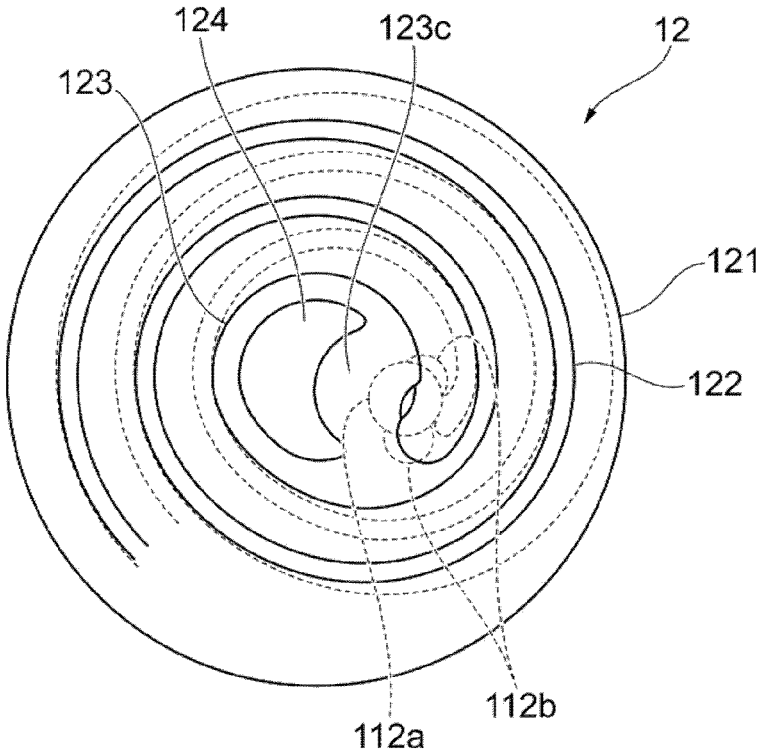

The fixed scroll portion 11 may also include a recess 112*b*. That is, the scroll compressor 1 may include the recess 112*b* provided in the fixed scroll portion 11 and the recess 123*b* provided in the orbiting scroll portion 12 as shown in FIGS. 10A and 10B. Alternatively, as shown in FIGS. 11A and 11B, the fixed scroll portion 11 may have the recess 112*b*, and the orbiting scroll portion 12 may not have a recess. FIGS. 10A and 11A and FIGS. 10B and 11B show the positional relationship between the fixed scroll portion 11 and the orbiting scroll portion 12 when the orbiting scroll portion 12 is engaged with the fixed scroll portion 11 and orbits. Dotted lines in FIGS. 10A and 11A and FIGS. 10B and 11B indicate the fixed scroll portion 11.

When the recess 112*b* is provided on the inner surface of the fixed scroll portion 11 that slides relative to the shaft support portion 123, the high-pressure space 124 may be disposed to avoid the through hole 112*a* or the recess 112*b* as shown in FIGS. 10A and 11A and FIGS. 10B and 11B.

Figure 12:
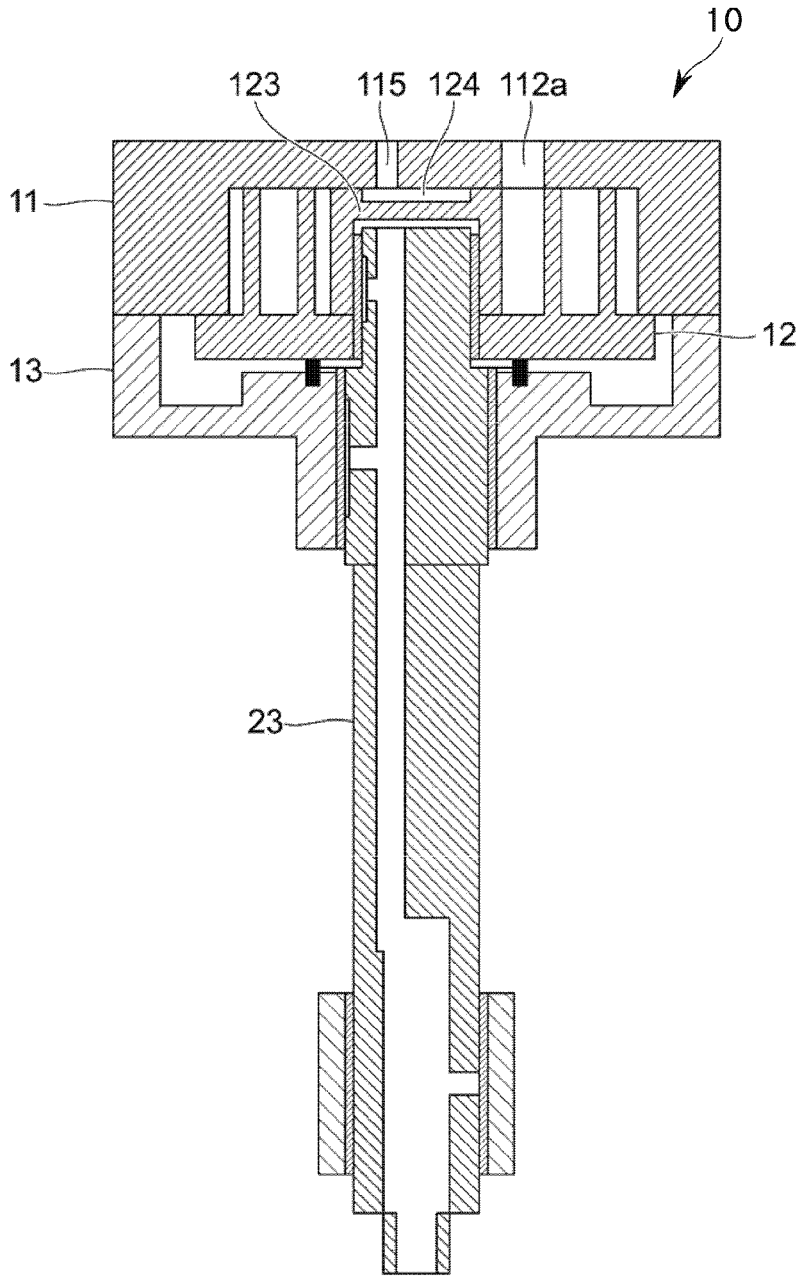
FIG. 12 is a cross-sectional view illustrating a compression portion and a rotating shaft of the scroll compressor according to the first embodiment of the disclosure.

Referring to FIG. 12, the fixed scroll portion 11 includes a first communication path 115 communicating the discharge space inside the sealed case 30 with the high-pressure space 124. The inside of the sealed case 30 is maintained at a high pressure by the gas discharged through the through hole 112*a*, and the high-pressure space 124 is caused to communicate with the discharge space inside the sealed case 30 by the first communication path 115 and thus is maintained at a high pressure while the scroll compressor 1 is operating. As such, when the high-pressure space 124 is maintained at the discharge pressure, the load acting on the upper surface of the shaft support portion 123 is stabilized so that the operation of the orbiting scroll portion 12 is stabilized, and friction between the shaft support portion 123 and the inner surface of the fixed scroll portion 11 is reduced, so that energy loss is reduced.

Figure 13:
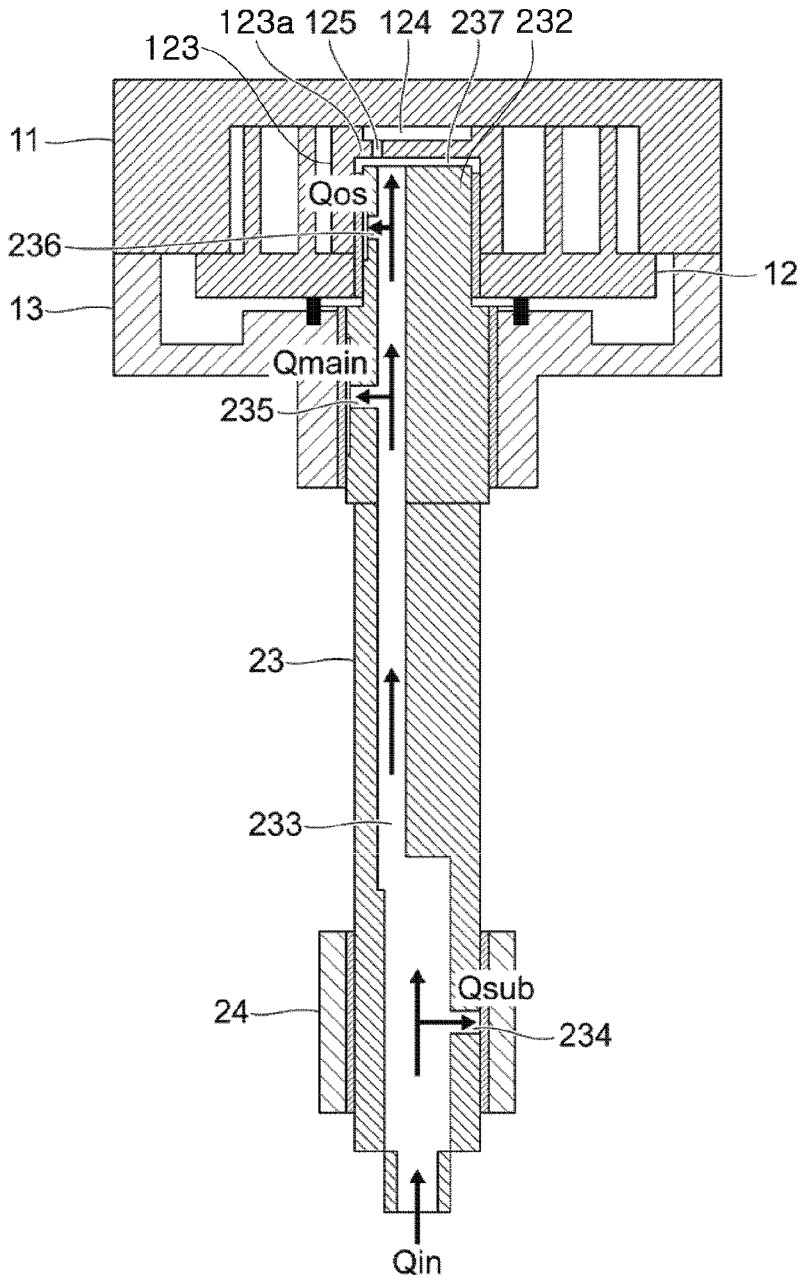
FIG. 13 is a cross-sectional view illustrating a compression portion and a rotating shaft of the scroll compressor according to the second embodiment of the disclosure.

FIG. 13 is a cross-sectional view illustrating a compression portion and a rotating shaft a scroll compressor according to the second embodiment of the disclosure. In the second embodiment, the shaft support portion 123 includes: an inner space 237 formed by the separation between the upper end of the eccentric portion 232 of the rotating shaft 23 and the inner surface of the closing portion 123*a*; and a second communication hole 125 communicating the high-pressure space 124 with the inner space at an inner side of the shaft support portion 123. The inner space 237 is formed to communicate with the discharge space inside the sealed case 30 by the oil supply passage 233 open from the bottom to the top of the rotating shaft 23. Therefore, the inner space 237 may be maintained at a discharge pressure of high pressure, and the high-pressure space 124 may also be maintained at a discharge pressure of high pressure due to communicating with the inner space 237 by the second communication hole 125.

Therefore, the scroll compressor according to the second embodiment may also stabilize the operation of the orbiting scroll portion 12 by stabilizing the load acting on the upper surface of the shaft support portion 123, and may reduce energy loss by reducing friction between the shaft support portion 123 and the inner surface of the fixed scroll portion 11.

Referring to FIG. 13, when the scroll compressor 1 is operated, a lubricant Qin rises along the oil supply passage 233 of the rotating shaft 23, and during the rising, a part Qsub of the lubricant is supplied to the bearing of the support member 24 through the first oil supply hole 234. A substantial amount of lubricant Qmain of the lubricant rising along the oil supply passage 233 is supplied to the bearings of the frame 13 through the second oil supply hole 235, and a part Qos of the lubricant is supplied toward the bearing of the shaft support portion 123 through the third oil supply hole 236.

In the second embodiment, since the inner space 237 and the high-pressure space 124 communicate with the oil supply passage 233, the inner space 237 and the high-pressure space 124 may also be filled with a lubricant.

Therefore, friction between the shaft support portion 123 and the fixed scroll portion 11 during operation may be minimized.

Figure 14:
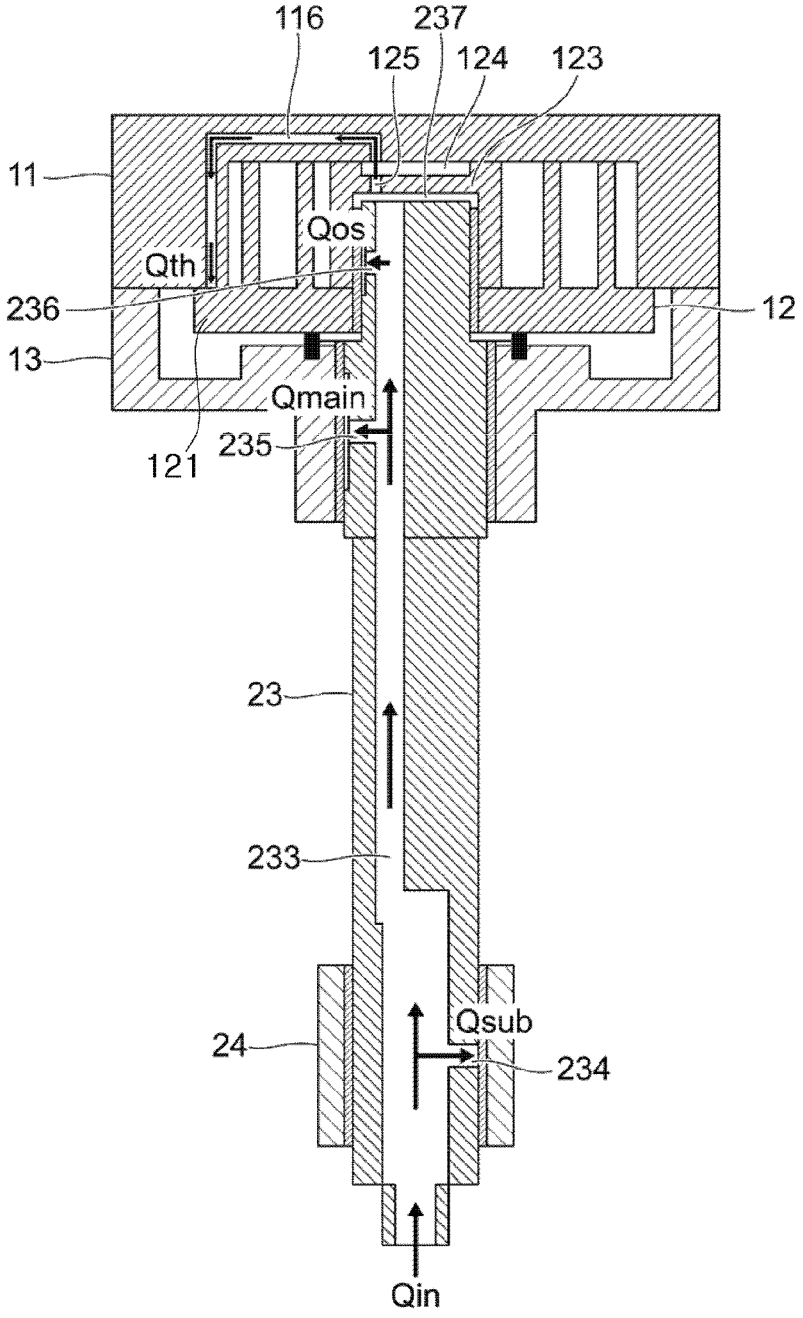
FIG. 14 is a cross-sectional view illustrating a compression portion and a rotating shaft of the scroll compressor according to the third embodiment of the disclosure.

FIG. 14 is a cross-sectional view illustrating a compression portion and a rotating shaft according to the third embodiment. The fixed scroll portion 11 according to the third embodiment includes an auxiliary oil supply passage 116 that guides a lubricant filled in the high-pressure space 124 to a friction surface that makes friction with the circumferential portion of the orbiting plate 121 of the orbiting scroll portion 12. In the third embodiment, the friction surface on which a thrust load acts is supplied with a lubricant Qth through the auxiliary oil supply passage 116, so that friction due to the operation of the orbiting scroll portion 11 may be reduced, and the operation of the orbiting scroll portion 11 may be stabilized.

Figure 15:
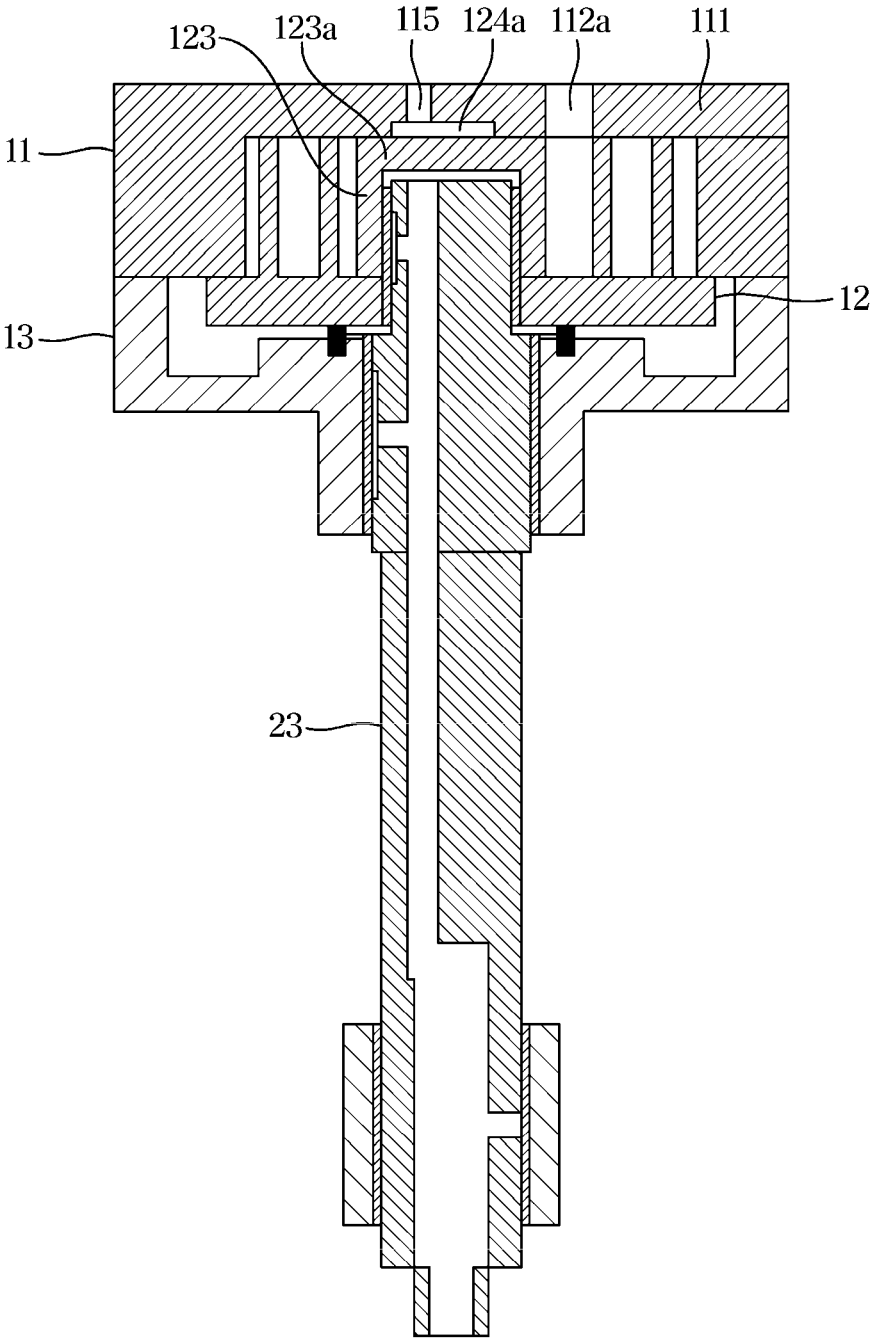
FIG. 15 is a cross-sectional view illustrating a compression portion and a rotating shaft of the scroll compressor according to the fourth embodiment of the disclosure.

FIG. 15 is a cross-sectional view illustrating a compression portion and a rotating shaft according to the fourth embodiment. In the fourth embodiment, a high-pressure space 124*a* on which a discharge pressure acts is formed on an inner surface of the cover portion 112 of the fixed scroll portion 11 facing the closing portion 123*a* of the shaft support portion 123, and the high-pressure space 124*a* communicates with the discharge space through the first communication path 115. A high-pressure space is not formed on the upper surface of the closing portion 123*a* of the shaft support portion 123. In this case, the high-pressure space 124*a* is provided in a size such that the high-pressure space 124*a* is occluded by the upper surface of the closing portion 123*a* of the shaft support portion 123 even with the orbiting movement of the shaft support portion 123.

In the fourth embodiment, the high-pressure space 124*a* is maintained at the discharge pressure, so that the load acting on the upper surface of the shaft support portion 123 may be stabilized to stabilize the operation of the orbiting scroll portion 12 as in the first embodiment (FIG. 12). In addition, the friction between the shaft support portion 123 and the inner surface of the fixed scroll portion 11 may be reduced to reduce energy loss.

Figure 16:
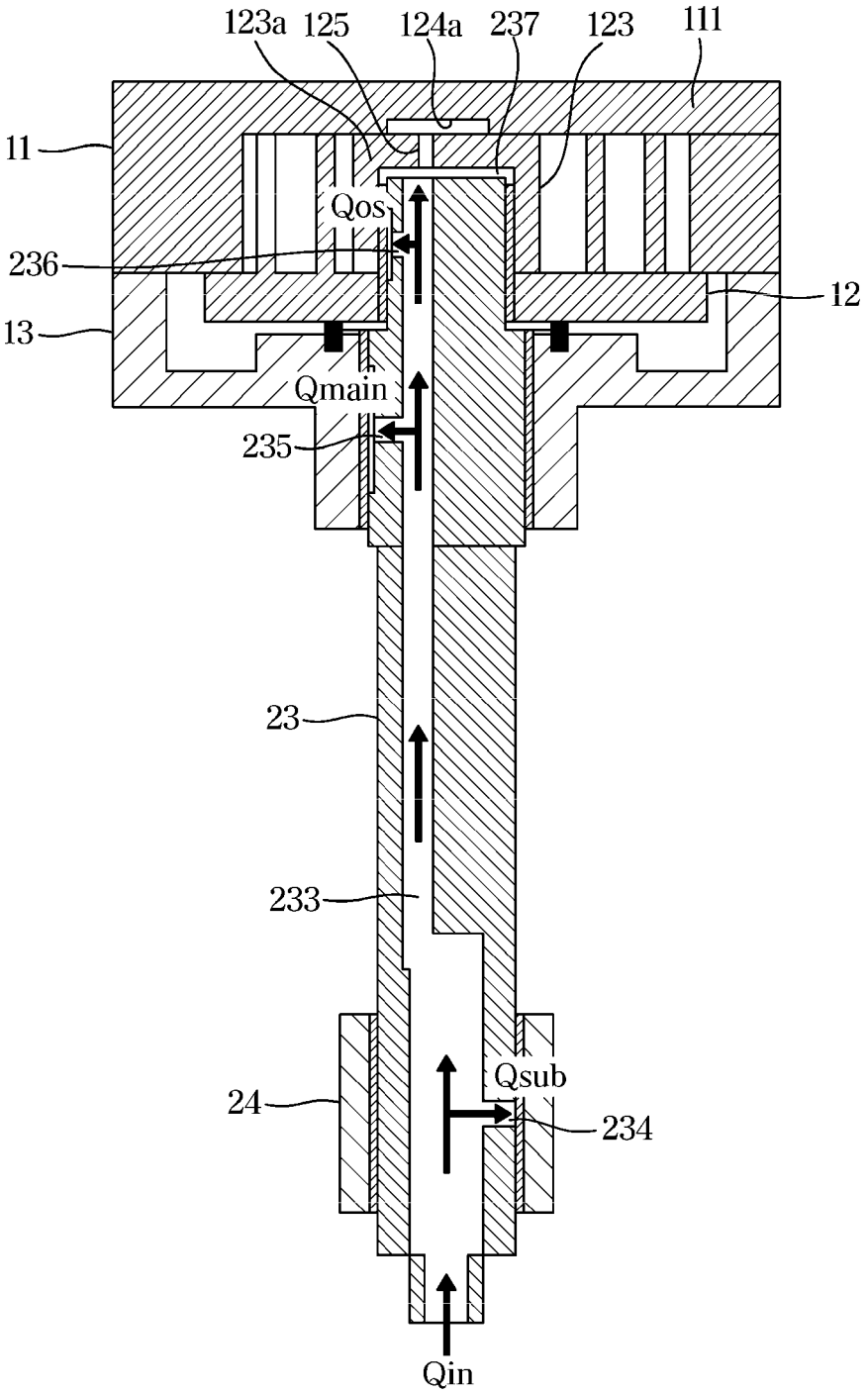
FIG. 16 is a cross-sectional view illustrating a compression portion and a rotating shaft of the scroll compressor according to the fifth embodiment of the disclosure.

FIG. 16 is a cross-sectional view illustrating a compression portion and a rotating shaft according to the fifth embodiment. In the fifth embodiment, a high-pressure space 124*a* on which a discharge pressure acts is formed on an inner surface of the cover portion 112 of the fixed scroll portion 11 facing the closing portion 123*a* of the shaft support portion 123, and the high-pressure space 124*a* communicates with the inner space 237 at an inner side of the shaft support through the second communication hole 125.

Therefore, the fifth embodiment may stabilize the operation of the orbiting scroll portion 12 by stabilizing the load acting on the upper surface of the shaft support portion 123 as in the second embodiment (FIG. 13), and may reduce energy loss by reducing friction between the shaft support portion 123 and the inner surface of the fixed scroll portion 11. In addition, the inner space 237 and the high-pressure space 124*a* are filled with lubricant, so that friction in the operation of the shaft support portion 123 and the fixed scroll portion 11 may be minimized.

Figure 17:
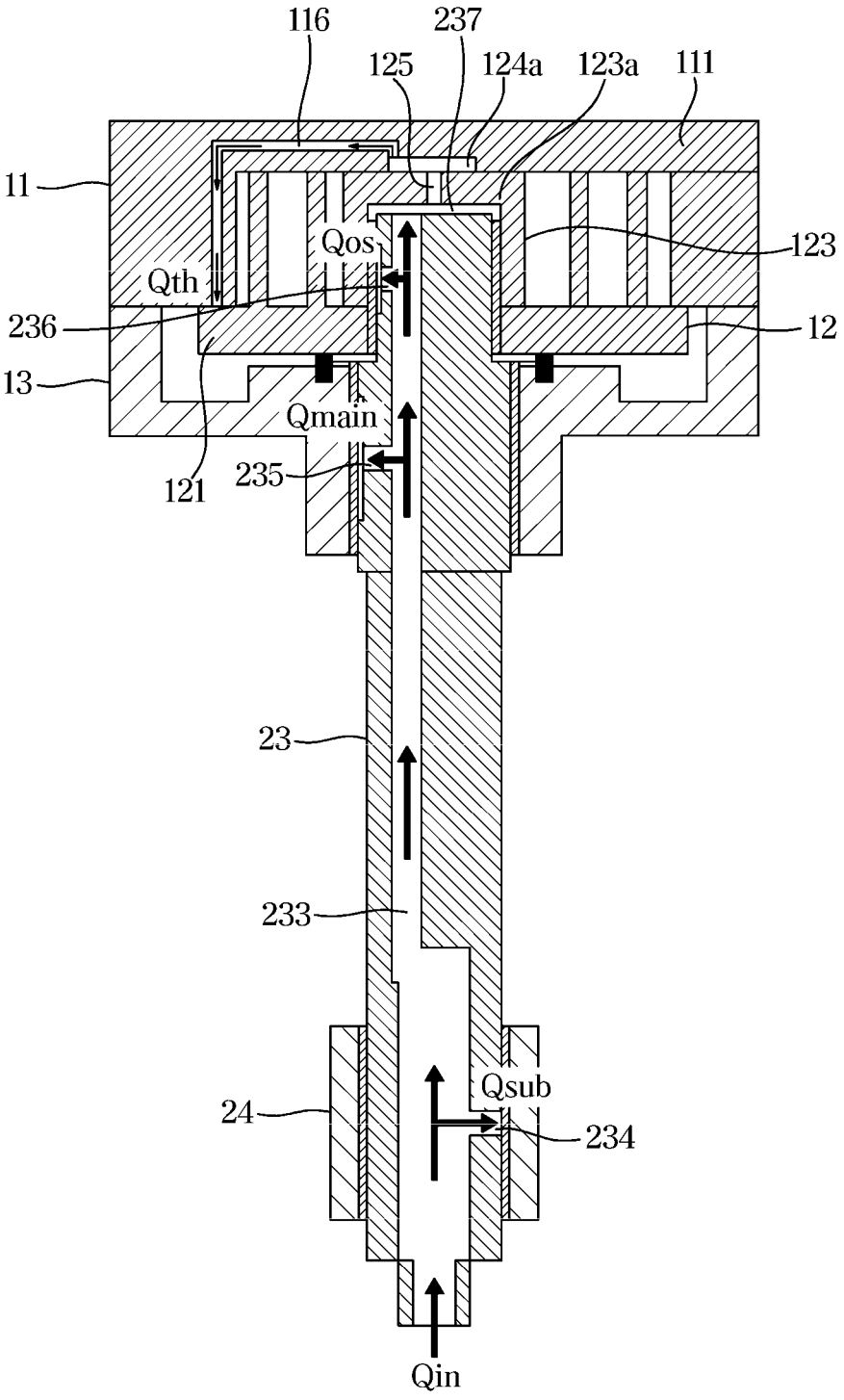
FIG. 17 is a cross-sectional view illustrating a compression portion and a rotating shaft of the scroll compressor according to the sixth embodiment of the disclosure.

FIG. 17 is a cross-sectional view illustrating a compression portion and a rotating shaft according to the sixth embodiment. The sixth embodiment includes an auxiliary oil supply passage 116 in addition to the configuration of the fifth embodiment. The auxiliary oil supply passage 116 may guide the lubricant filled in the high-pressure space 124*a* of the fixed scroll portion 11 to a frictional surface at the circumference side of the orbiting scroll portion 12.

Therefore, in the sixth embodiment, the friction surface on which the thrust load acts is supplied with a lubricant Qth through the auxiliary oil supply passage 116 as in the third embodiment, so that the friction caused by the operation of the orbiting scroll portion 11 is reduced, and the operation of the orbiting scroll portion 11 is stabilized.

Figure 18:
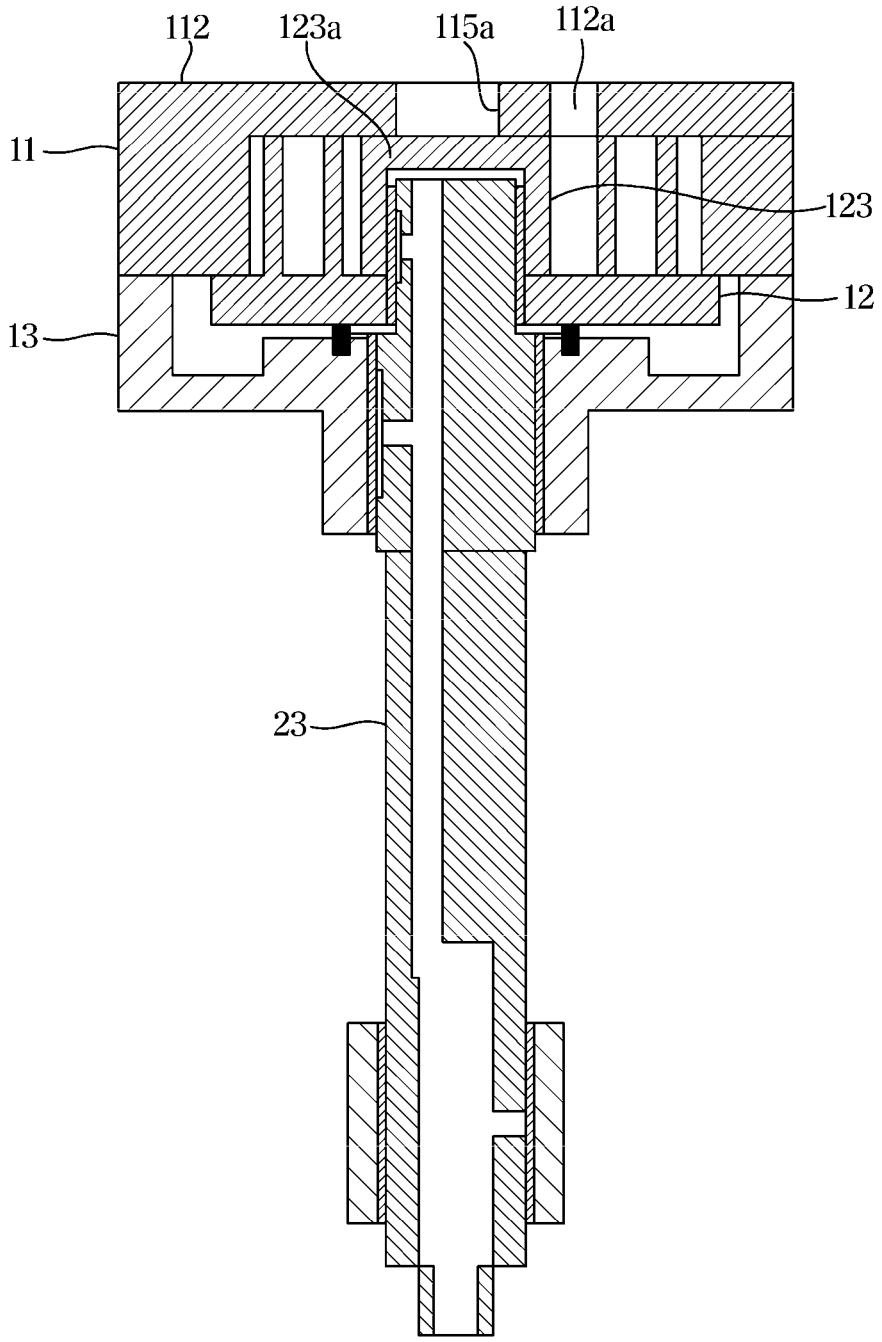
FIG. 18 is a cross-sectional view illustrating a compression portion and a rotating shaft of the scroll compressor according to the seventh embodiment of the disclosure.

FIG. 18 is a cross-sectional view illustrating a compression portion and a rotating shaft according to the seventh embodiment. The seventh embodiment includes an opening 115*a* formed to allow an outer surface of the closing portion 123*a* of the shaft support portion 123 facing the inner surface of the cover portion 112 of the fixed scroll portion 11 to be exposed to the discharge pressure outside of the fixed scroll portion 11.

The opening 115*a* allows a central portion of the outer surface of the closing portion 123*a* to be exposed by a size corresponding to that of the high-pressure space described above, so that a part of the outer surface of the closing portion 123*a* is directly exposed to the discharge space inside the sealed case 30. The opening 115*a* is formed to have a diameter smaller than a diameter of the outer surface of the closing portion 123*a* so as to remain closed by the outer surface of the closing portion 123*a* even with the orbiting operation of the orbiting scroll portion 12. FIG. 18 illustrates a case where the opening 115*a* is provided as a single opening, but the opening 115*a* may be provided in plural.

In the seventh embodiment, the outer surface of the closing portion 123*a* exposed by the opening 115*a* is exposed to the discharge pressure, so that the load acting on the upper surface of the shaft support portion 123 may be stabilized and the operation of the orbiting scroll portion 12 may be stabilized as in the first embodiment (FIG. 12), and friction between the shaft support portion 123 and the inner surface of the fixed scroll portion 11 may be reduced so that energy loss may be reduced.

As is apparent from the above, the scroll compressor according to the embodiment is provided a high-pressure space, on which a discharge pressure acts, on an outer surface of a closing surface of a shaft support portion facing an inner surface of a fixed scroll portion, so that a load acting on an upper surface of the shaft support portion of the orbiting scroll portion can be stabilized, thereby stabilizing the operation of the orbiting scroll portion.

The scroll compressor according to the embodiment of the disclosure is provided with a high-pressure space on the upper surface of the shaft support portion, and allows a lubricant ⚷ to be supplied to the high-pressure space, so that energy loss due to a friction between the shaft support portion of the orbiting scroll portion and the fixed scroll portion can be reduced.

The scroll compressor according to the embodiment of the disclosure allows a lubricant to be supplied to a friction surface that makes a friction with a circumference portion of the orbiting scroll portion through an auxiliary oil supply passage, so that friction due to the operation of the orbiting scroll portion can be reduced and the orbiting scroll portion can be smoothly operated.

Although the present disclosure has been described with various embodiments, various changes and modifications may be suggested to one skilled in the art. It is intended that the present disclosure encompass such changes and modifications as fall within the scope of the appended claims.

What is claimed is:

1. A scroll compressor comprising:

a sealed case;

a fixed scroll portion fixed at an inside of the sealed case and provided with a fixed scroll vane;

an orbiting scroll portion provided with an orbiting scroll vane that is coupled to the fixed scroll vane; and a rotating shaft formed to allow the orbiting scroll portion to orbit, wherein the orbiting scroll portion includes a shaft support portion provided at a center portion thereof and formed to allow the orbiting scrolling portion to be coupled to the rotating shaft, and wherein the shaft support portion includes:

a closing portion provided to cover an end portion of the rotating shaft and configured to slide while in contact with an inner surface of the fixed scroll portion, a high-pressure space formed in an outer surface of the closing portion that faces the inner surface of the fixed scroll portion and on which a discharge pressure is configured to act, an inner space formed between the end portion of the rotating shaft and the closing portion and disposed at a side opposite to the high-pressure space, and a communication hole formed to allow the high-pressure space to communicate with the inner space.

2. The scroll compressor of claim 1, wherein the closing portion is provided to face the inner surface of the fixed scroll portion in a direction in which the orbiting scroll portion is coupled to the fixed scroll portion.

3. The scroll compressor of claim 1, wherein:

the sealed case includes a discharge space to which a refrigerant discharged from a compression portion formed by the fixed scroll portion and the orbiting scroll portion is configured to flow, and the fixed scroll portion includes a communication path configured to communicate the discharge space with the high-pressure space.

4. The scroll compressor of claim 3, wherein the high-pressure space is provided to allow at least a portion of the refrigerant discharged from the discharge space to be introduced through the communication path when the orbiting scroll portion orbits.

5. The scroll compressor of claim 3, wherein the communication path is provided to be open in a direction corresponding to a direction in which the orbiting scroll portion is coupled to the fixed scroll portion.

6. The scroll compressor of claim 1, wherein the shaft support portion includes a sealing portion configured to form a circumference of the high-pressure space, the shaft support portion is configured to slide while in contact with the inner surface of the fixed scroll portion.

7. The scroll compressor of claim 6, wherein the sealing portion has a thickness equal to a thickness of the orbiting scroll vane.

8. The scroll compressor of claim 1, wherein the high-pressure space is formed to be recessed from the outer surface of the closing portion at a depth of 0.5 mm or greater.

9. The scroll compressor of claim 1, wherein:

the rotating shaft includes an oil supply passage formed inside the rotating shaft and through which a lubricant is caused to flow, and at least a portion of the oil supply passage is provided to communicate with the inner space.

10. The scroll compressor of claim 9, wherein the inner space and the high-pressure space are provided to be filled with the lubricant supplied through the oil supply passage.

11. The scroll compressor of claim 10, wherein the fixed scroll portion includes:

a friction surface configured to make friction with a circumferential portion of the orbiting scroll portion; and an auxiliary oil supply passage provided to allow the lubricant of the high-pressure space to flow to the friction surface.

12. A scroll compressor comprising:

a sealed case including a discharge space to which a high pressure refrigerant is configured to flow;

a fixed scroll portion fixed at an inside of the sealed case and provided with a fixed scroll vane;

an orbiting scroll portion provided with an orbiting scroll vane that is coupled to the fixed scroll vane;

a compression portion formed by the fixed scroll portion and the orbiting scroll portion, the compression portion configured to discharge the high pressure refrigerant to the discharge space; and a rotating shaft formed to allow the orbiting scroll portion to orbit, wherein the orbiting scroll portion includes a shaft support portion provided at a center portion thereof and formed to allow the orbiting scroll portion to be coupled to the rotating shaft, wherein the shaft support portion includes:

a closing portion provided to cover an end portion of the rotating shaft and configured to slide while in contact with an inner surface of the fixed scroll portion, and an inner space formed by separation between the end portion of the rotating shaft and an inner surface of the closing portion, wherein one of the closing portion and the inner surface of the fixed scroll portion includes a high-pressure space configured to communicate with the discharge space and on which a discharge pressure is configured to act, and wherein the shaft support portion further includes a communication hole formed to allow the high-pressure space to communicate with the inner space.

13. The scroll compressor of claim 12, wherein the high-pressure space is formed on the inner surface of the fixed scroll portion facing the closing portion of the shaft support portion.

14. The scroll compressor of claim 13, wherein the fixed scroll portion includes a communication path configured to communicate the discharge space with the high-pressure space.

15. The scroll compressor of claim 12, wherein the inner space and the high-pressure space are filled with a lubricant supplied through an oil supply passage of the rotating shaft.

16. The scroll compressor of claim 15, wherein the fixed scroll portion includes an auxiliary oil supply passage provided to allow the lubricant of the high-pressure space to flow to a friction surface that is configured to make friction with a circumferential portion of the orbiting scroll portion.

17. A scroll compressor comprising:

a fixed scroll portion fixed at an inside of a sealed case and provided with a fixed scroll vane;

an orbiting scroll portion provided with an orbiting scroll vane that is coupled to the fixed scroll vane;

a rotating shaft formed to allow the orbiting scroll portion to orbit; and a shaft support portion provided at a center portion of the orbiting scroll portion and to which the rotating shaft is coupled, the shaft support portion including a closing portion provided to cover an end portion of the rotating shaft and is slidably supported while in contact with an inner surface of the fixed scroll portion, wherein the fixed scroll portion includes an opening configured to allow an outer surface of the closing portion of the shaft support portion facing the inner surface of the fixed scroll portion to be exposed to a discharge pressure of outside of the fixed scroll portion, and wherein the opening is configured to remain closed by the outer surface of the closing portion during an orbiting movement of the orbiting scroll portion.

* * * * *